US009566702B2

(12) United States Patent
Kuzma

(10) Patent No.: US 9,566,702 B2
(45) Date of Patent: Feb. 14, 2017

(54) HYDRAULIC ROTATOR CONVERTER FOR A HYDRAULIC IMPACT HAMMER AND METHOD

(71) Applicant: JW Tooling, LLC, Monroe, CT (US)

(72) Inventor: Wayne T. Kuzma, Torrington, CT (US)

(73) Assignee: JW Tooling, LLC, Monroe, CT (US)

( * ) Notice: Subject to any disclaimer, the term of this patent is extended or adjusted under 35 U.S.C. 154(b) by 425 days.

(21) Appl. No.: 14/303,930

(22) Filed: Jun. 13, 2014

(65) Prior Publication Data

US 2014/0367133 A1 Dec. 18, 2014

Related U.S. Application Data

(60) Provisional application No. 61/836,412, filed on Jun. 18, 2013.

(51) Int. Cl.

| | |
|---|---|
| ***E21B 7/02*** | (2006.01) |
| ***B25D 17/00*** | (2006.01) |
| ***B25D 16/00*** | (2006.01) |
| ***E02D 7/26*** | (2006.01) |
| *E21B 49/02* | (2006.01) |
| *B25D 9/12* | (2006.01) |

(Continued)

(52) U.S. Cl.

CPC ..... *B25D 17/005* (2013.01); *B25D 16/00* (2013.01); *E02D 7/26* (2013.01); *E21B 7/02* (2013.01); *B25D 9/12* (2013.01); *E02D 17/02* (2013.01); *E21B 1/02* (2013.01); *E21B 7/026* (2013.01); *E21B 49/02* (2013.01); *Y10T 29/49716* (2015.01)

(58) Field of Classification Search

CPC ..... E21B 1/00; E21B 1/02; E21B 7/02; E21B 7/024; E21B 7/028; E21B 7/208;E21B 7/006; E21B 7/20; E21B 7/24; E21B 19/086; E21B 19/16; E21B 19/24; E21B 15/04; E21B 49/00; E21B 49/02; B25D 9/12; B25D 9/145; B25D 16/00; E02D 7/00; E02D 7/26; E02D 17/02

USPC ..... 173/1, 28, 104, 132, 105, 128, 213, 216, 173/218, 164, 195, 46, 29; 405/232, 244; 175/20, 202, 171, 332, 162, 220, 170, 175/209

See application file for complete search history.

(56) References Cited

U.S. PATENT DOCUMENTS 2,914,305 A * 11/1959 Wink ..... B28D 1/041 173/216
3,680,412 A * 8/1972 Mayer ..... E21B 19/20 173/147

(Continued)

OTHER PUBLICATIONS

Wikipedia article representing the state of the hammer drill art prior to Jun. 18, 2013; whole article.

*Primary Examiner* — Scott A. Smith
(74) *Attorney, Agent, or Firm* — Ware, Fressola, Maguire & Barber LLP

(57) ABSTRACT

A hydraulic rotator converter for attachment to a hydraulic impact hammer having a hammer housing and a hydraulic piston. The converter has mounting brackets, a rotator housing, posts attached to the rotator housing and attachable to the mounting brackets, a hydraulic rotator assembly including a hydraulic rotator, a rotator wheel driven by the hydraulic rotator, and a rotator plate connected to the rotator wheel, the rotator plate having a central cutout region formed therein, and a rotator drill bit dimensioned to pass through a central cutout region of the rotator plate and to engage with the central cutout region so as to be rotatable by (Continued)

the rotator wheel while allowing the rotator drill bit to move in an axis perpendicular to a longitudinal axis of the drill bit.

17 Claims, 7 Drawing Sheets

(51) Int. Cl.
*E02D 17/02* (2006.01)
*E21B 1/02* (2006.01)

(56) References Cited

U.S. PATENT DOCUMENTS 4,022,108 A * 5/1977 Juvonen ..... B25D 9/12 91/276
4,232,752 A * 11/1980 Hauk ..... E21B 1/02 173/133
4,296,821 A * 10/1981 Larson ..... E21B 6/00 173/104
4,371,041 A * 2/1983 Becker ..... E21B 3/02 173/147
4,482,021 A * 11/1984 Repski ..... E21B 7/006 175/209
4,585,080 A * 4/1986 Bender ..... E21B 7/024 173/29
4,637,475 A * 1/1987 England ..... E21B 7/025 173/193
4,869,626 A * 9/1989 Kosmowski ..... B23B 31/14 310/12.04
5,058,688 A * 10/1991 Scott ..... E21B 7/24 175/122
5,060,734 A * 10/1991 Anderson ..... B25D 9/145 173/128
5,570,975 A * 11/1996 Reinert, Sr. ..... E02D 7/26 173/184
5,730,230 A * 3/1998 Sisler ..... B25D 16/00 173/105
5,950,741 A * 9/1999 Wright ..... E21B 7/006 175/20
7,980,322 B2 * 7/2011 Desmeules ..... E21B 7/24 173/128

* cited by examiner

HYDRAULIC ROTATOR CONVERTER FOR A HYDRAULIC IMPACT HAMMER AND METHOD

CROSS REFERENCE TO RELATED APPLICATION

This application claims priority under 35 USC §119 to U.S. Provisional Patent Application No. 61/836,412 filed on Jun. 28, 2013, whose contents are hereby incorporated by reference in their entirety.

TECHNICAL FIELD

The present invention is directed to a hydraulic rotator converter for a hydraulic impact hammer, as well as a method for converting a hydraulic impact hammer into a hydraulic rotator system.

BACKGROUND OF THE INVENTION

Hydraulic impact hammers, sometimes known as hydraulic hammers, are devices which typically attach to an excavator or similar type of machinery and are used for breaking rock, stone, concrete and other hard objects by repetitively pounding such objects with an elongated hammer tool typically having a carbide tip at its pounding end. The hydraulic impact hammer typically includes a hydraulic reciprocating mechanism for causing the hammer tool to repetitively move (pound) downward relative to the hydraulic hammer (upward return movement results from the object pushing against the hammer tool when hydraulic downward movement is repetitively released), thereby providing the impact pounding force to the hammer tool for impacting objects, such as stone and concrete.

It has been found that such hydraulic hammers are not able to easily drill holes into such objects, especially certain types of stone due to the fact that the hammer tool causes the stone to form a particulate powder as it pounds into the stone. This accumulated powder in a hole being drilled dissipates much of the energy of the hydraulic tool, thereby making the drilling process a slow, time-consuming process.

SUMMARY OF THE INVENTION

The present invention provides a solution to such slow drilling of stone, rock, concrete and other hard objects by a hydraulic hammer by providing a rotating motion to a drill bit as it reciprocatingly pounds into the object. The rotating action of the drill bit allows powder formed by the pounding action to be removed from the hole being formed in the object and therefore greatly facilitates the pounding action and thus the overall drilling action of the drill bit as it pounds and rotates simultaneously into the object.

The present invention relates to a hydraulic rotator converter for attachment to a hydraulic impact hammer having a hammer housing and a hydraulic piston comprising mounting brackets configured to attach to the hammer housing, a rotator housing having a cavity formed therein, posts attached to the rotator housing at a first end of each post, each post having a second end for removable connection to one of the mounting brackets, a hydraulic rotator assembly mounted in the cavity of the rotator housing, the assembly including a hydraulic rotator, a rotator wheel with a central opening, the rotator wheel driven by the hydraulic rotator, and a rotator plate connected to the rotator wheel, the rotator plate having a central cutout region formed therein, and a rotator drill bit having a drilling end and a second end, the drill bit positioned in the hammer housing so as to be contacted by the hydraulic piston, the rotator drill bit dimensioned to pass through the central cutout region of the rotator plate and the central opening of the rotator wheel and wherein the drill bit has a cutout region arranged to engage with the central cutout region of the rotator plate so as to be rotatable by the rotator wheel while allowing the hydraulic piston to generate pounding action on drill bit.

Another embodiment of the present invention is the hydraulic rotator converter as described above, wherein the second end of the posts are secured to the hammer housing by pins placed in the second end of each post after passage through an opening in each mounting bracket.

Another embodiment of the present invention is the hydraulic rotator converter as described above, wherein the rotator plate comprises two halves, each half secured to the rotator wheel.

A further embodiment of the present invention is the hydraulic rotator converter as described above, wherein the rotator wheel has a plurality of holes formed therein for receipt of bolts passing through the rotator plate so as to secure the plate to the rotator wheel.

A still further embodiment of the present invention is the hydraulic rotator converter as described above, wherein the rotator housing comprises a rectangular portion, a lower plate and an upper plate, the lower plate and the upper plate attached to the rectangular portion, each plate including an opening for passage of the drill bit.

Another embodiment of the present invention is the hydraulic rotator converter as described above, further comprising a bushing assembly attached around the hole in the upper plate and a bushing assembly positioned around the hole in the lower plate, the bushing assemblies having a bushing therein for engagement with bushing rides formed in the drilling bit.

A further embodiment of the present invention is the hydraulic rotator converter as described above, wherein the drilling bit further comprises bushing rides for contacting bushings formed in the hammer housing.

A still further embodiment of the present invention is the hydraulic rotator converter as described above, wherein the drill bit includes a carbide tip secured to a drilling end of the drill bit.

A further embodiment of the present invention is the hydraulic rotator converter as described above, wherein the hydraulic rotator includes a gear driven by the hydraulic rotator and wherein the rotator wheel includes a gear engaged with the gear of the hydraulic rotator so as to be driven thereby.

Another embodiment of the present invention is the hydraulic rotator converter as described above, further comprising a pair of locks positionable in the hammer housing so as to prevent the drill bit from falling out of the hammer housing when the drill bit is not in contact with an object.

A further embodiment of the present invention is the hydraulic rotator converter as described above, wherein the locks are postionable about a cutout region in the drill bit.

Another embodiment of the present invention is the hydraulic rotator converter as described above, further comprising ball valves and button fittings that are associated with a hydraulic feed and a hydraulic return line used with the hydraulic hammer so as to allow quick connect/disconnect of a hydraulic feed line and a hydraulic return line associated with the hydraulic rotator.

A further embodiment of the present invention is the hydraulic rotator converter as described above, further comprising hooks attached to the hammer housing for securing the hydraulic feed line and hydraulic return line associated with the hydraulic rotator to the hammer housing.

Another embodiment of the present invention is a method of converting a hydraulic impact hammer associated with a hammer tool to a hydraulic impact hammer associated with a hydraulic rotator converter as described above, comprising the steps of removing locks associated with a hammer tool installed in a hammer housing of the hydraulic impact hammer so as to allow release of the hammer tool from the hydraulic impact hammer, placing the hammer housing over a drill bit of the hydraulic rotator converter, installing locks through the hammer housing so as to secure the hydraulic rotator converter to the hammer housing, and attaching a hydraulic feed line and a hydraulic return line to the hydraulic rotator converter.

Another embodiment of the present invention is the method of converting a hydraulic impact hammer associated with a hammer tool to a hydraulic impact hammer associated with a hydraulic rotator converter as described above, wherein the step of attaching a hydraulic feed line and a hydraulic return line to the hydraulic rotator converter further comprises respectively attaching the hydraulic feed line and the hydraulic return line to a hydraulic feed line and hydraulic return line of the hydraulic impact hammer.

A further embodiment of the present invention is the method of converting a hydraulic impact hammer as described, further comprising placing the hammer tool in a stand upon removal of the hammer tool from the hydraulic impact hammer and placing the hydraulic rotator converter in a stand prior to installing the hydraulic rotator converter into the hammer housing.

Another embodiment of the present invention is a method of removing a hydraulic rotator converter as described above from a hammer housing of a hydraulic impact hammer so as to install a hammer tool in the hammer housing, comprising the steps of removing a hydraulic feed line and a hydraulic return line from the hydraulic rotator converter, removing locks associated with the hydraulic rotator converter so as to release the hydraulic rotator converter from the hydraulic impact hammer, placing the hammer housing over a hammer tool, and installing locks through the hammer housing to secure the hammer tool to the hammer housing.

DETAILED DESCRIPTION

Figure 1:
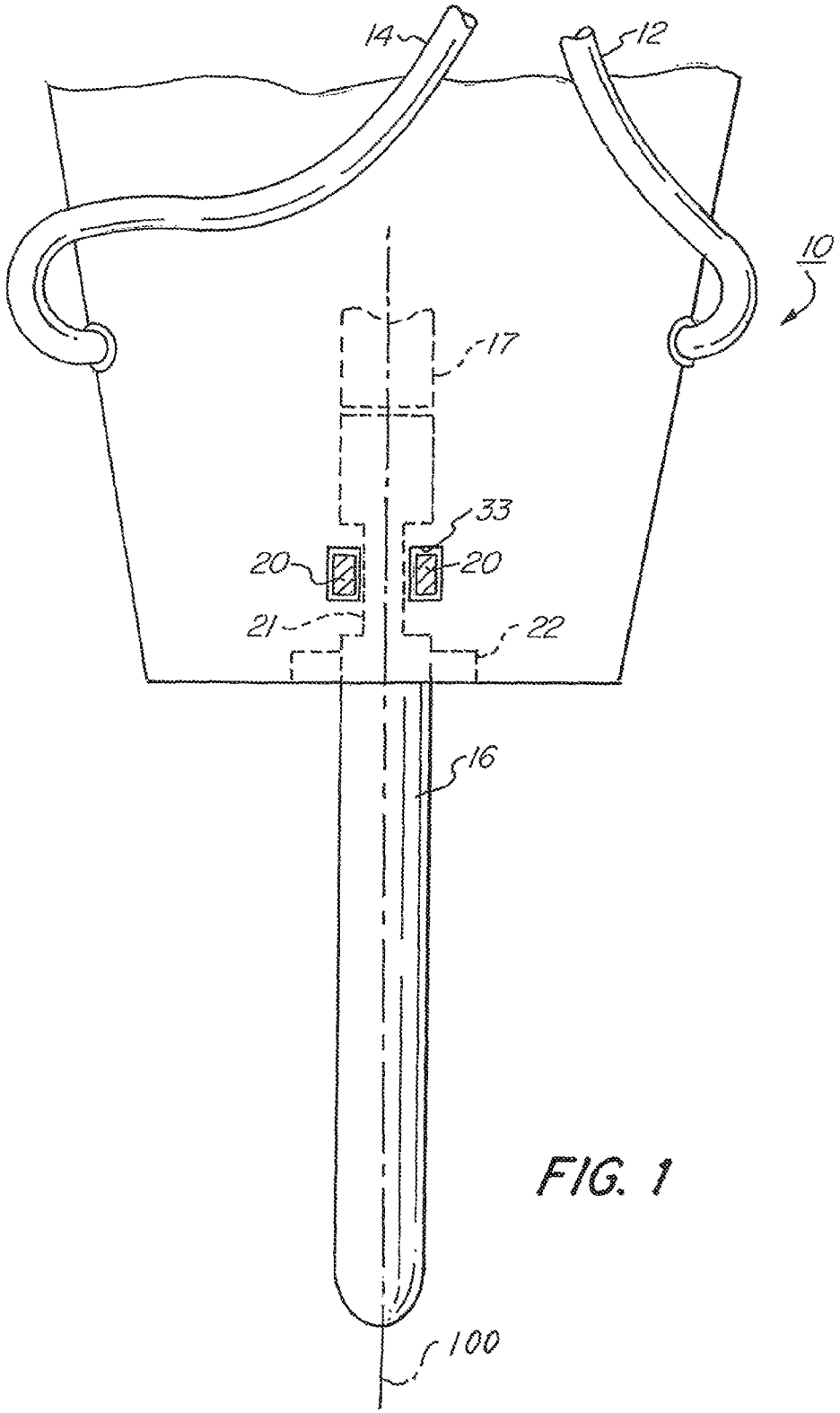
FIG. 1 is a partial diagrammatic side view of a prior art hydraulic impact hammer with a hammer tool attached thereto.
Figure 4A:
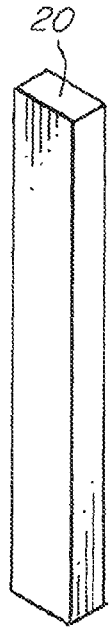
FIG. 4A is a perspective view of a lock used with the present invention.
Figure 5:
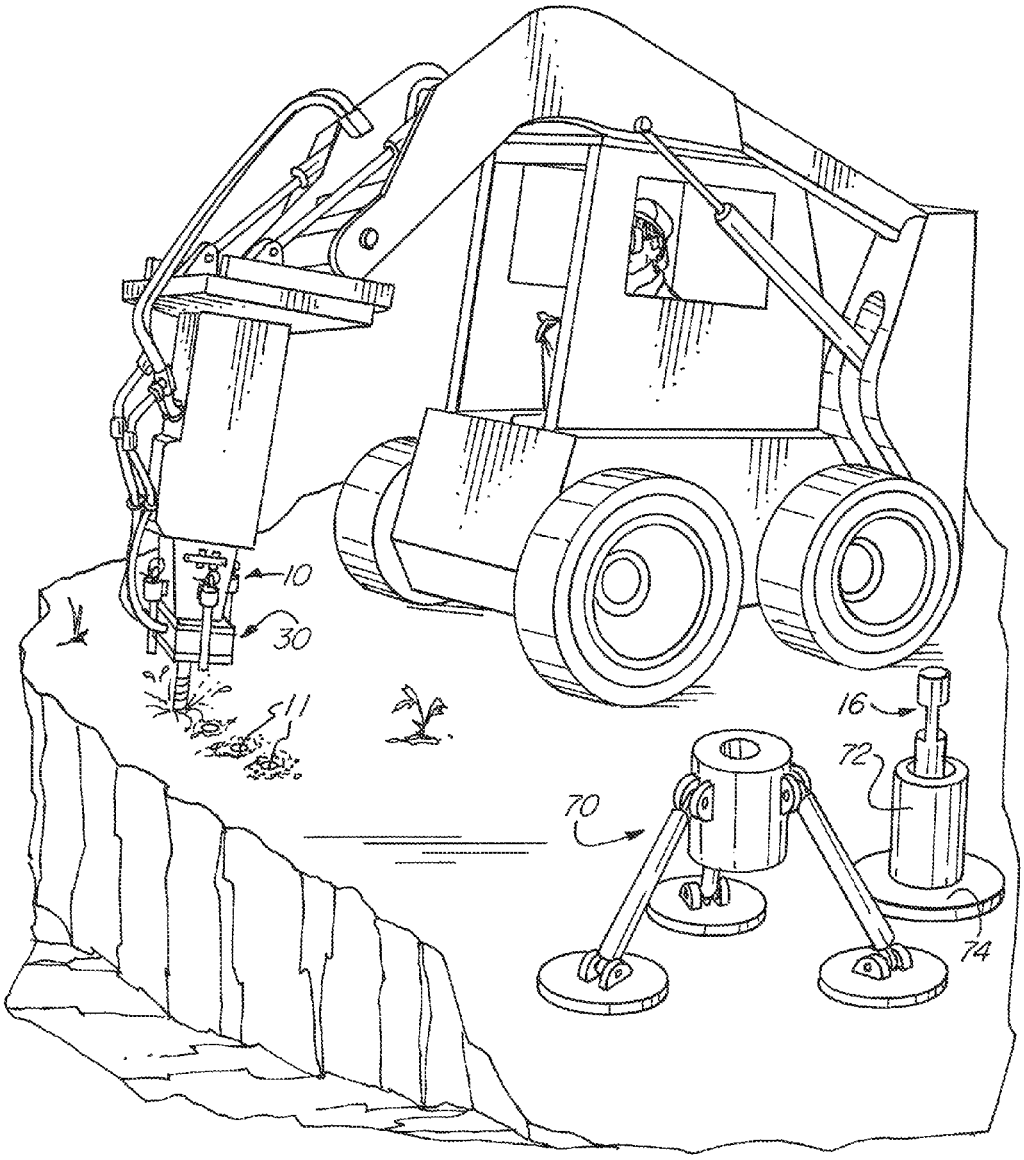
FIG. 5 is a perspective view of an excavator with the hydraulic rotator converter attached to a hydraulic impact hammer, illustrating how holes are drilled in a hard object such as stone, and also illustrating a stand for supporting a hammer tool and a stand for supporting a hydraulic rotator converter.

FIG. 1 illustrates a partial diagrammatic view of a conventional hydraulic impact hammer 10 used for excavating, mining and other applications in which stone, concrete, or other hard material needs to be broken into smaller pieces, typically for removal thereof, Such a conventional hammer 10 has a hydraulic feed line 12 and a hydraulic return line 14 for providing the hydraulic fluid for powering the hydraulic impact hammer. The hammer also includes a hammer tool (hammer bit) 16 which performs the actual pounding of the stone or other object to be broken. The pounding imparted to the hammer tool is from a hydraulic piston 17 (shown in phantom) that is connected to the feed and return lines 12 and 14. This hammer tool can be removed from the hammer housing 18 by means of locks 20. The locks are also seen in FIG. 4A. Locks 20 pass through cutouts 33 in hammer housing 18 and are positioned between flat cutout region 21 formed in hammer tool 16. The cutout regions have a length relative to the longitudinal axis 100 of the hammer tool that is greater than the corresponding height of each lock 20 so that the locks are not in contact with the hammer tool when it is being pounded by hydraulic piston 17. The locks prevent the hammer tool from falling out of hammer housing 18 when the hydraulic hammer 10 is lifted away from the ground as seen in FIG. 5. The hammer housing also typically includes bushing assemblies 15 and 22.

Figure 2:
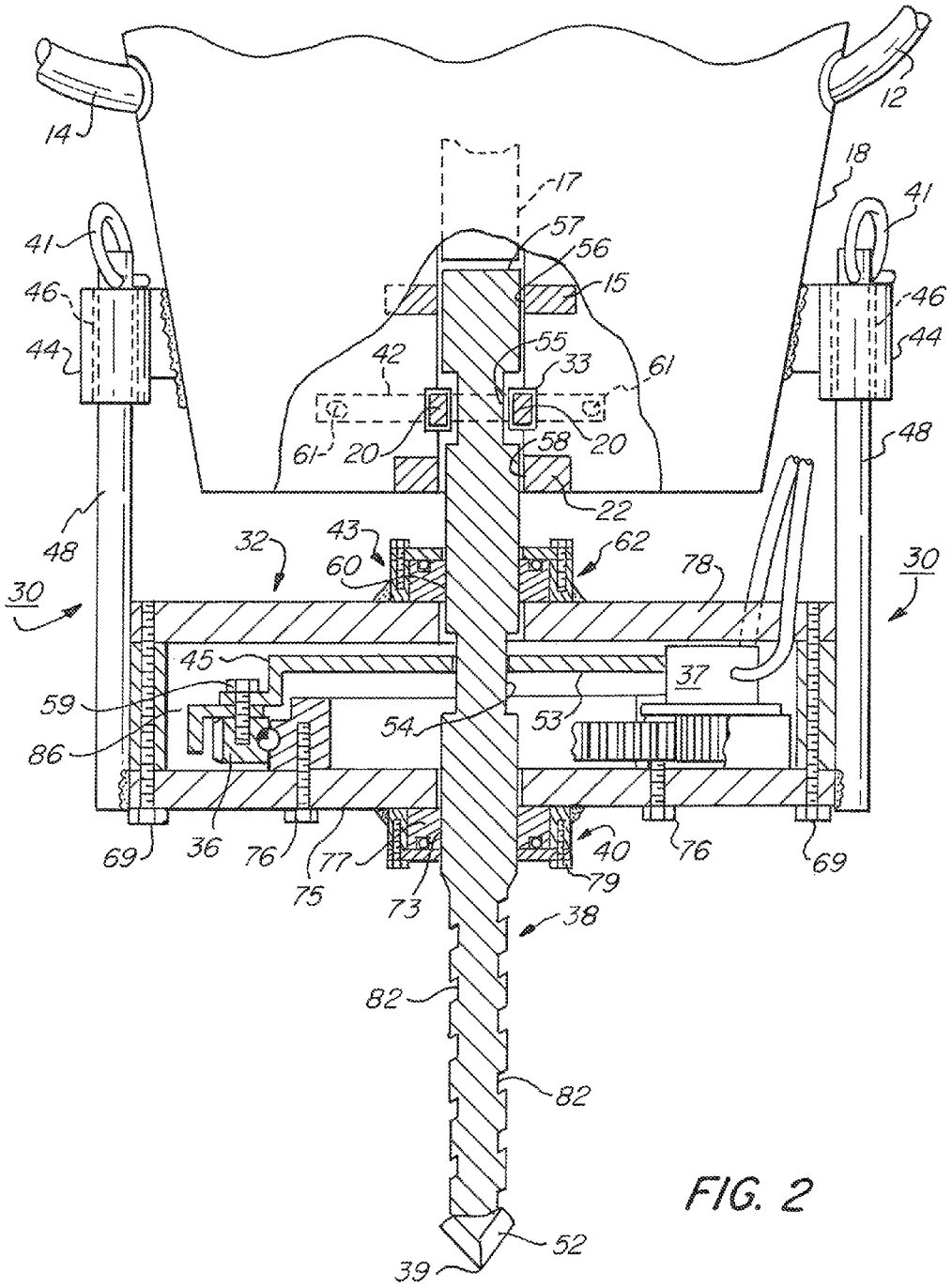
FIG. 2 is a cross-sectional view of a hydraulic rotator converter according to an embodiment of the present invention attached to a hydraulic impact hammer.

FIG. 2 is a partial cross-sectional side view of a hydraulic rotator converter 30 according to an embodiment of the present invention. The converter includes a rotator housing 32, a hydraulically driven worm drive hydraulic rotator 34, a rotator wheel 36 driven by the hydraulic rotator 34, a rotator drill bit 38, a lower bushing assembly 40, an upper bushing assembly 43 and locks 20 for locking the rotator drill bit within the hammer housing 18.

Figure 3:
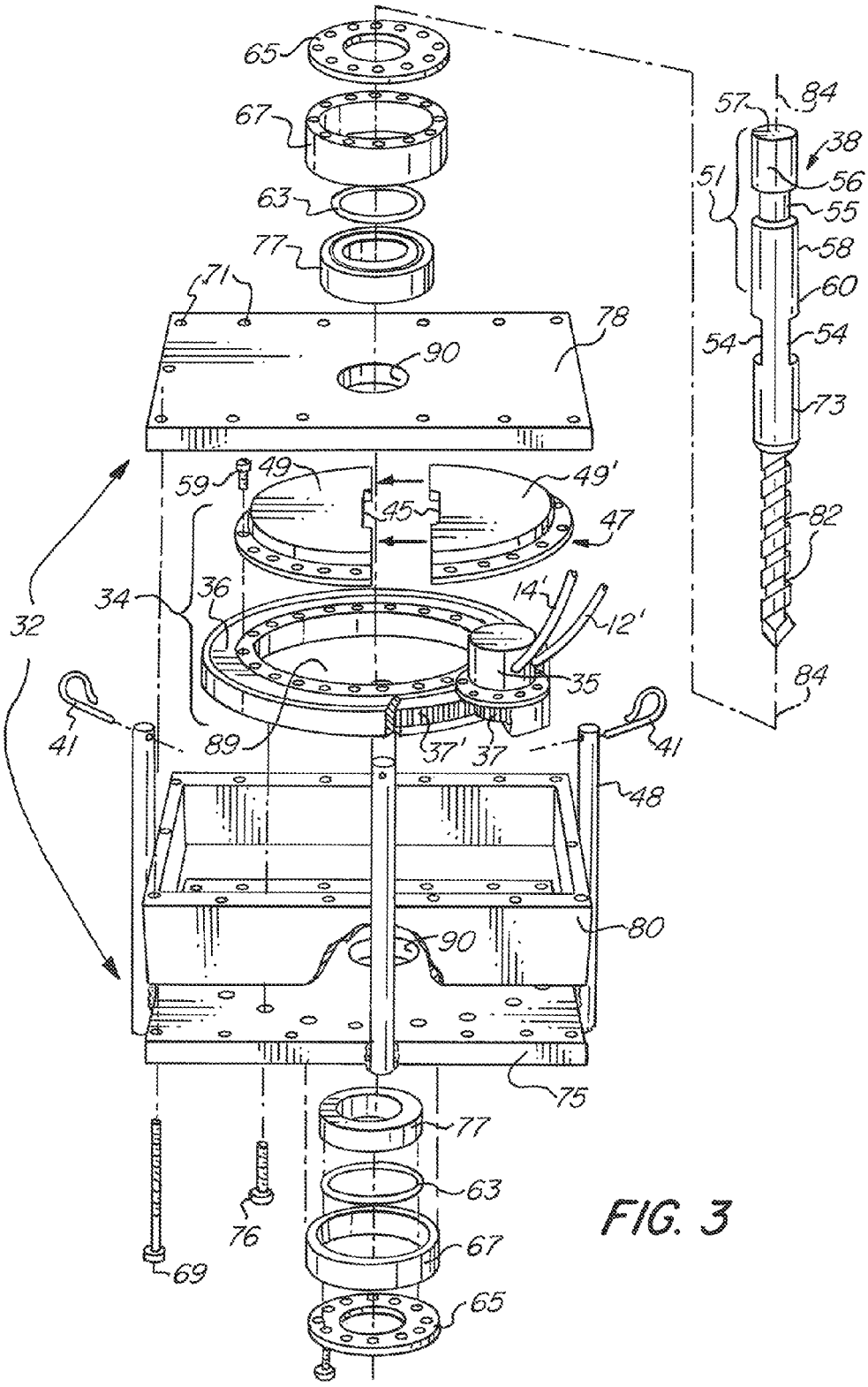
FIG. 3 is an exploded perspective assembly view of the hydraulic rotator converter including the drill bit used therewith.

As seen in FIG. 3, the hydraulic rotator 34 turns a gear 37 that drives a larger gear 37' on rotator wheel 36.

Figure 4:
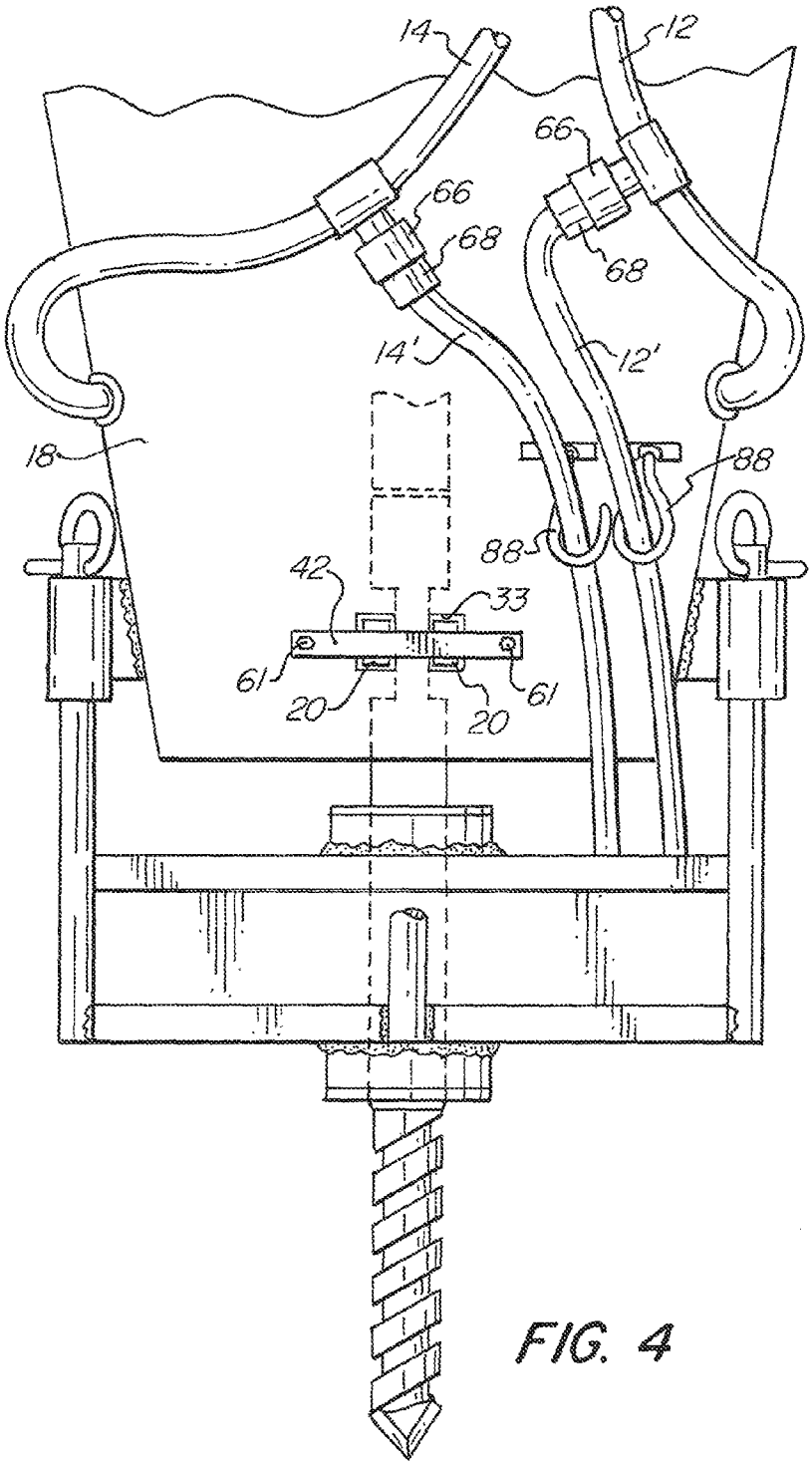
FIG. 4 is a partial side view (partially in cross-section) of a hydraulic impact hammer with the hydraulic rotator converter of the present invention attached thereto showing placement of hydraulic feed lines and locks and stop bar to secure the drill bit to the hammer tool.

As seen in FIG. 4, bolts 61 secure a stop bar 42 to hammer housing 18 via holes 13 formed therein (see FIGS. 6-11). The stop bar 42 is positioned adjacent locks 20 to prevent disengagement of locks 20 from indented cylindrical region 55 of rotator drill bit 38, especially when drill bit 38 is pounded by hydraulic piston 17. A stop bar may be positioned on both sides of hammer housing 18 that have cutouts 33 formed therein.

As discussed above with respect to hammer tool 16, the cutout region 55 of drill bit 38 has a longitudinal length (along axis 84) that is greater than corresponding height of locks 20 (as viewed in FIG. 2) so that the locks are not in contact with the drill bit when it is being pounded by hydraulic piston 17. The locks prevent the drill bit from falling out of hammer housing 18 when the hydraulic hammer 10 is lifted away from the ground as seen in FIG. 5.

The rotator housing 32 is removably secured to the hammer housing 18 by means of mounting brackets 44 secured to the hammer housing. These mounting brackets can be secured to the hammer housing by welding or other means well-known in the art. As seen also in FIG. 2, each bracket includes a mounting hole 46 dimensioned for receipt of mounting posts 48. Four brackets can be used, one mounted to each side of hammer housing 18. Fewer or more mounting brackets may be used. The mounting posts pass through the mounting holes 46 in the mounting brackets and are secured thereto by hitch pins 41. The mounting posts are secured at their other end to the housing 32, such as by welding. Other attachment mechanisms, such as mounting bolts or the like, can be used instead of welding. Once secured, the hydraulic rotator connector housing 32 is securely affixed to the hammer housing.

Other devices besides mounting brackets and posts can be used to position rotator housing 32 below hammer housing 18, such as mounting holes formed in hammer housing 18 with posts or other type of standoff connecting rotator housing to hammer housing 18.

Details of the drill bit 38 are also shown in FIGS. 2-3. It is there seen that the rotator drill bit typically has a carbide tip 52 at its drilling end 39 for assisting when drilling into hard substances, such as stone, concrete and the like. The drill bit includes a spline (flattened region) 54 which mates with cutout regions 45 of rotator plate 47 (see FIG. 3).

FIG. 3 also shows that drill bit 38 includes a top (end) 57 that is impacted by hydraulic piston 17 in the same manner as described above with respect to hammer tool 16. FIGS. 2 and 3 show that indented region 55 is cylindrical in configuration so as to allow drill bit 38 to rotate when secured in hammer housing 18. The drill bit also includes a helical groove 82 that extends from end 39 of the drill bit. This helical groove when turning is able to facilitate removal of particulate matter from a hole being drilled (see FIG. 5), which greatly facilitates the drilling process since particulate matter that results from pounding the stone or other hard material does not stay in the hole (which otherwise would absorb the pounding action of drill bit end 39).

FIGS. 2 and 3 also show that rotator housing 32 has a cavity 86 formed therein of sufficient size to house hydraulic rotator assembly 34, including hydraulic rotator 35, (including driven gear 37), driven gear 37' (forming part of rotator wheel 36 on the periphery thereof) and rotator plate 47. Rotator plate 47 is formed by two halves, 49 and 49' that are both secured to rotator wheel 36 via machine screws 59. Rotator wheel 36 has a central opening 89 (for passage of drill bit 38) and is secured to lower plate 75 of rotator housing 32 by machine screws 76. Other types of fasteners for machine screws 59 and 76 could be used, as well known in the art. The rotator plate has cutouts 45 in each half (49, 49') that mate with spline region 54 of drill bit 38 so as to rotate drill bit 38 as wheel 36 is rotated by hydraulic rotator 35.

FIG. 2 also shows that bolts 69 are used to secure upper plate 78 of rotator housing 32, with rectangular box portion 80 and lower plate 75 to form the overall rotator housing 32. FIG. 3 shows these elements in additional detail. Upper plate 78 and lower plate 75 each includes a central hole 90 to allow passage of drill bit 38.

FIG. 3 shows the use of four mounting posts 48 to secure the rotator housing to the hammer housing 18. These posts can be fastened to lower plate 75 via welding or the like. Fewer or more mounting posts or similar structural elements (such as beams and elongated flanges) may be used.

As seen in FIG. 3, the drill bit has a region 51 that predominantly resides inside the hammer housing 18 which includes an indented region 55 for receipt of locks 20. An end 57 (top) of the drill bit opposite the carbide tip end 39 is pounded by piston 17. The drill bit includes a first bushing ride 56 and a second bushing ride 58 for mating with bushing assemblies 15 and 22 within the hammer housing. The drill bit also includes a third bushing ride 60 in a region between the hammer housing and the rotator housing 32 when mounted to the impact hammer. A fourth bushing ride 73 is positioned below splines 54 as viewed in FIG. 3. The third and fourth bushing rides are configured to mate with corresponding bushing assemblies 43 and 40 positioned on the rotator housing 32. The bushing assemblies each include grease seals 63, a seal plate 65, a sleeve 67 and a bushing 77. Bolts 79 secure the seal plate to the sleeve. These bushing assemblies may be welded to rotator housing 32 (bushing assembly 43 to upper plate 78 and bushing assembly 40 to lower plate 75). Other fastening techniques could of course be used.

As seen in FIGS. 3, bolts 69 are threaded into tapped holes 71 in upper plate 78 so as to secure the rotator housing 32. The drill bit has a helical groove 82 or cut-out configuration to allow stone or concrete powder (particulate matter) formed during use of the impact hammer to be removed from a hole being drilled by the impact hammer. Such removal is due to the rotation of the drill bit.

Other features of the hydraulic rotator converter are shown in the figures. Thus, FIG. 4 shows that for providing hydraulic fluid to the hydraulic rotator 34, the hydraulic rotator converter includes a pair of detent ball valves 66 which connect to the hydraulic feed line 12 and return line 14 along with no drip button fittings 68 so as to provide hydraulic fluid to the hydraulic rotator 37 via feed line 12' and return line 14'. These feed lines are used while still providing hydraulic fluid to the hydraulic hammer 10. Hose loop brackets 88 may be installed onto hammer housing 18 to facilitate maintenance of the hydraulic feed and return lines. Thus, in operation, when the hydraulic rotator converter is installed to the hammer housing 18, the hammer still generates pounding action but this pounding action occurs with simultaneous rotation of the drill bit 38. This has been found to facilitate drilling of holes in stone and other hard substances.

As seen in FIG. 5, once the holes 11 are drilled in a desired hole pattern, the hydraulic rotator converter can be quickly removed from the hammer housing 18 with reinsertion of a standard hammer tool 16 so as to complete the stone fracturing by the hydraulic impact hammer in the holes generated by the hydraulic rotator converter. Typically, the hydraulic hammer tool 16 has a larger diameter than the drill bit 38 of the present invention so as to facilitate stone fracture. Feather and wedge type rock splitting can also be used once the holes are drilled.

Figure 8:
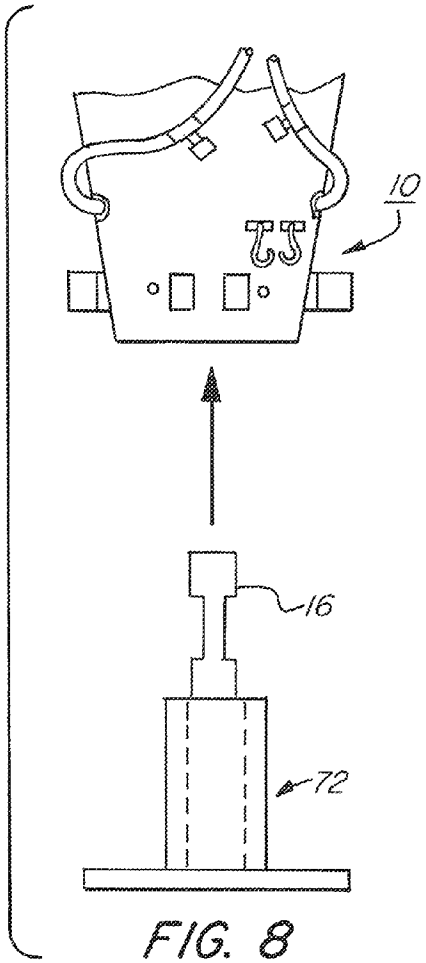
FIGS. 6-11 are a sequence of diagrammatic illustrations of the hydraulic impact hammer showing placement of a hammer tool in a stand, removal of locks so as to allow removal of the hammer tool from the hydraulic impact hammer, placement of the hammer tool in a stand, and placement of the hydraulic impact hammer over a hydraulic rotator converter positioned in a stand, including insertion of locks and a stop bar and attachment of the hydraulic rotator converter to the hammer housing, as well as connection of hydraulic feed lines.
Figure 7:
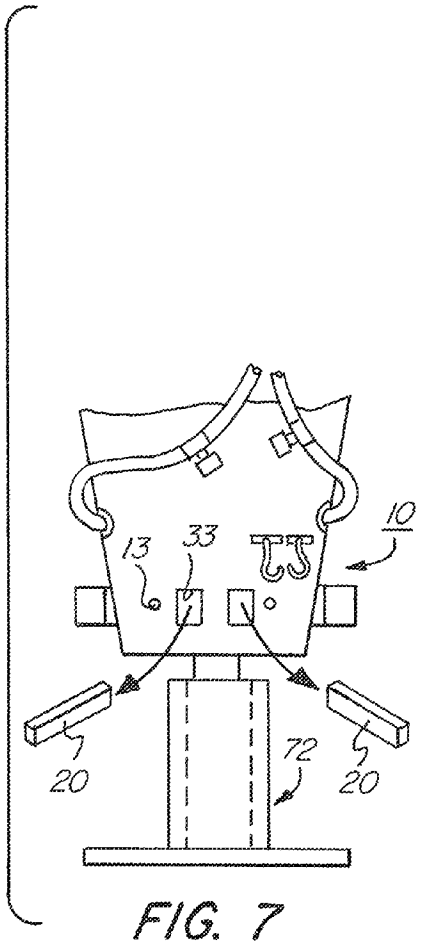
Figure 6:
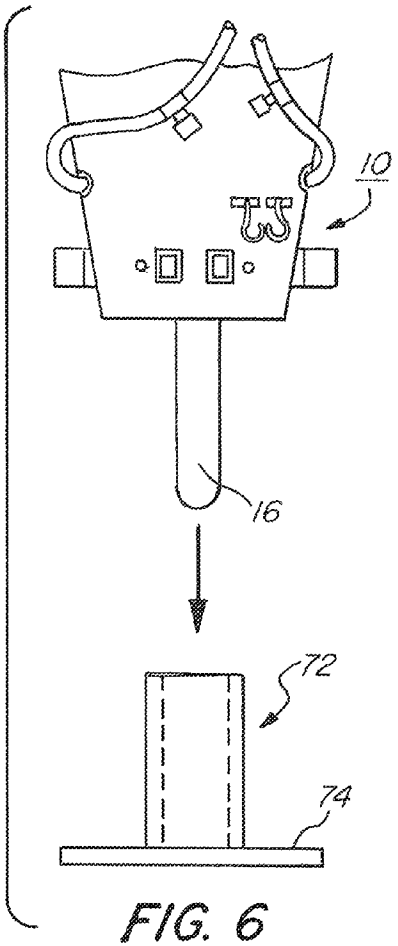
Figure 11:
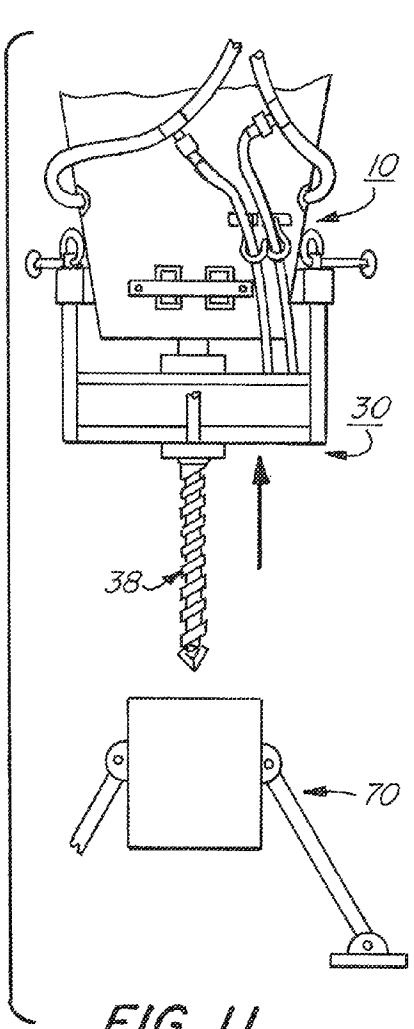
Figure 10:
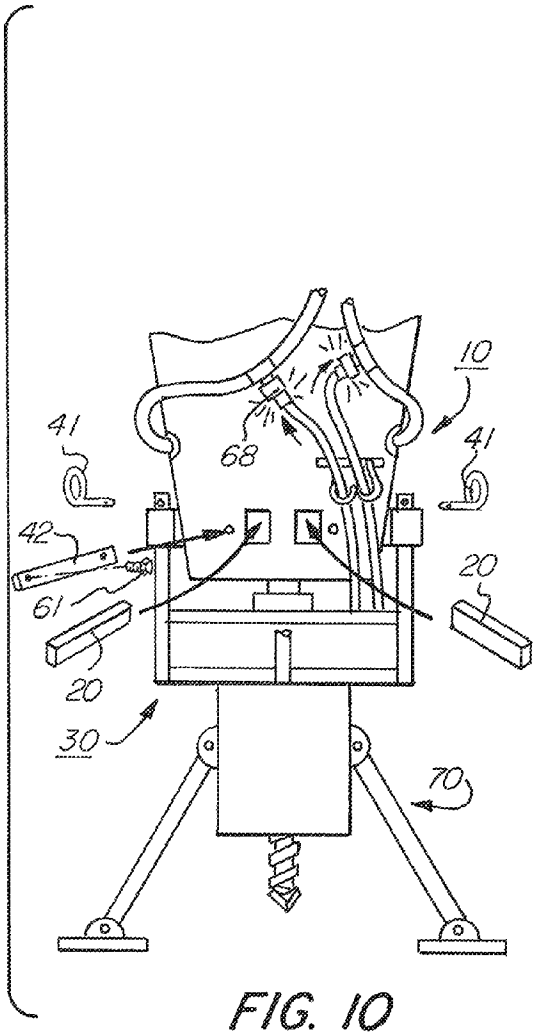
Figure 9:
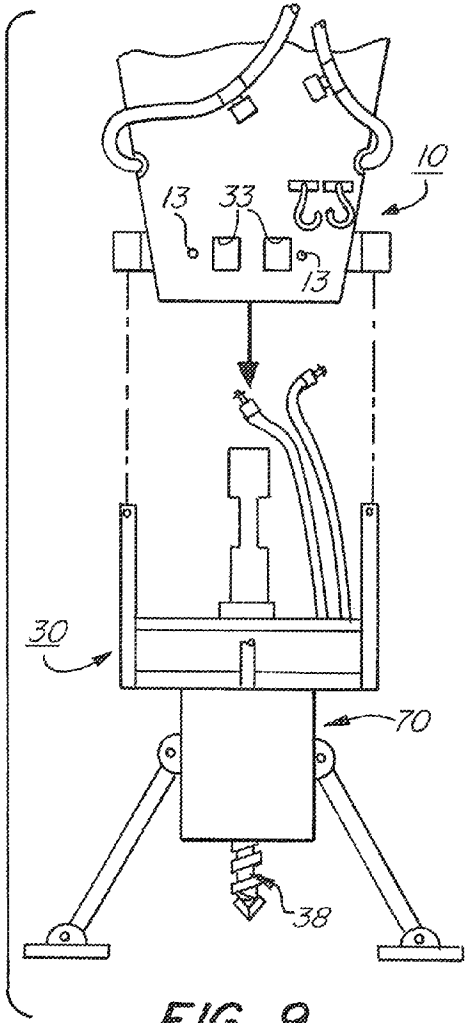

To facilitate quick changing of the hydraulic rotator converter from the hammer housing, the hydraulic rotator converter can be positioned in a hydraulic rotator converter stand 70 as seen in FIGS. 5 and 9-11. FIGS. 6-8 show that a stand 72 having a flat base 74 can be used to store the hammer tool 16 when the hammer tool is removed from the hammer housing. Because of the weight associated with this hammer tool (which is typically hundreds of pounds), as well as the weight of the hydraulic rotator converter (which is typically several hundreds of pounds), the hydraulic rotator converter stand 70 and the stand 72 for the hammer tool 16 are preferably used to facilitate easy exchange the hammer tool to the drill bit and vice versa.

The hydraulic rotator converter according to the present invention is particularly useful in the many situations in which hydraulic hammers are used to hammer rock in streets, trench rock, in an excavation hole or pit, between gas lines, along drainage lines, house cellar holes, large stones, etc. and in any application in which hammering must be done because blasting is either unsafe or not appropriate. As is well-known in the art, hammering by itself can take a long period of time for fracturing rock and thus the present invention which provides for drilling of holes in a pattern which are then to be used to hammer and fracture the rock greatly reduces the overall time for breaking and removing rock.

Thus, the present invention works similarly to what is known in the art as "feather and wedge", or "plug and feather", or "plug and wedges", or "wedges and shims" in which holes are first drilled in a rock and then a metal wedge (known as the plug) is used with two shims (known as the feather). The wedge is typically placed between the wedges and is hit with a hammer to exert sideward force to the wedges so as to split the rock. Multiple holes are typically used to fracture a large stone or segment of stone ledge. In general, when stone is in place, it is very hard to remove. However, by drilling a hole pattern first it gives relief to the stone and the stone will break much more easily when later hammered with the hammer tool associated with a hydraulic hammer.

The method of converting a hydraulic impact hammer to the hydraulic rotator according to the present invention is shown in FIGS. 6-11. It involves first placing the hydraulic hammer tool 16 into stand 72 and removing the locks 20 associated with the hammer tool 16. Afterwards, the hammer tool is disengaged from the hydraulic hammer, lifting the hydraulic hammer away from the hammer tool and placing the hammer housing 18 over the rotator converter 30, attaching the hydraulic hoses to fittings 68, installing the lock 20 and hitch pins 41 so as to secure the hydraulic rotator converter to the hammer housing and the hydraulic rotator drill bit 38 to the hammer housing. One or more stop bars 42 can be used to insure that locks 20 stay in place (one stop bar on each side of hammer housing 18 that has cutouts 33 for placement of locks therethrough). The reverse operations are used to remove the hydraulic rotator converter and reinstall the hydraulic hammer tool to the hammer housing.

Thus, what has been described is a hydraulic rotator converter that can easily be installed onto an existing hydraulic impact hammer housing so as to allow for quick drilling of holes in stone or other hard material and after the hole pattern is drilled, to quickly remove the hydraulic rotator converter from the hammer housing and to reinstall the hydraulic hammer tool for completing the breakage of the stone via insertion of the hydraulic hammer tool and pounding the holes drilled by the hydraulic rotator converter.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A hydraulic rotator converter for attachment to a hydraulic impact hammer having a hammer housing and a hydraulic piston comprising:

mounting brackets configured to attach to the hammer housing;

a rotator housing having a cavity formed therein;

posts attached to the rotator housing at a first end of each post, each post having a second end for removable connection to one of the mounting brackets;

a hydraulic rotator assembly mounted in the cavity of the rotator housing, the assembly including a hydraulic rotator, a rotator wheel with a central opening, the rotator wheel driven by the hydraulic rotator, and a rotator plate connected to the rotator wheel, the rotator plate having a central cutout region formed therein; and a drill bit having a drilling end and a second end, the second end positioned in the hammer housing so as to be contacted by the hydraulic piston, the drill bit dimensioned to pass through the central cutout region of the rotator plate and the central opening of the rotator wheel and wherein the drill bit comprises a cutout region arranged to engage with the central cutout region of the rotator plate so as to be rotatable by the rotator wheel while allowing the hydraulic piston to generate pounding action on the drill bit.

2. The hydraulic rotator converter according to claim 1, wherein the second end of the posts are secured to the hammer housing by pins placed in the second end of each post after passage through an opening in each mounting bracket.

3. The hydraulic rotator converter according to claim 1, wherein the rotator plate comprises two halves, each half secured to the rotator wheel.

4. The hydraulic rotator converter according to claim 3, wherein the rotator wheel has a plurality of holes formed therein for receipt of bolts passing through the rotator plate so as to secure the plate to the rotator wheel.

5. The hydraulic rotator converter according to claim 1, wherein the rotator housing comprises a rectangular portion, a lower plate and an upper plate, the lower plate and the upper plate attached to the rectangular portion, each plate including an opening for passage of the drill bit.

6. The hydraulic rotator converter according to claim 5, further comprising a bushing assembly attached around the hole in the upper plate and a bushing assembly positioned around the hole in the lower plate, the bushing assemblies having a bushing therein for engagement with bushing rides formed in the drilling bit.

7. The hydraulic rotator converter according to claim 6, wherein the drilling bit comprises further bushing rides for contacting bushings formed in the hammer housing.

8. The hydraulic rotator converter according to claim 1, wherein the drill bit includes a carbide tip secured to the drilling end of the drill bit.

9. The hydraulic rotator converter according to claim 1, wherein the hydraulic rotator includes a gear driven by the hydraulic rotator and wherein the rotator wheel includes a gear engaged with the gear of the hydraulic rotator so as to be driven thereby.

10. The hydraulic rotator converter according to claim 1, further comprising a pair of locks positionable in the hammer housing so as to prevent the drill bit from falling out of the hammer housing when the drill bit is not in contact with an object.

11. The hydraulic rotator converter according to claim 10, wherein the locks are postionable about a further cutout region in the drill bit.

12. The hydraulic rotator converter according to claim 1, further comprising ball valves and button fittings that are associated with a hydraulic feed and a hydraulic return line used with the hydraulic hammer so as to allow quick connect/disconnect of a hydraulic feed line and a hydraulic return line associated with the hydraulic rotator.

13. The hydraulic rotator converter according to claim 12, further comprising hooks attached to the hammer housing for securing the hydraulic feed line and hydraulic return line associated with the hydraulic rotator to the hammer housing.

14. A method of converting a hydraulic impact hammer associated with a hammer tool to a hydraulic impact hammer associated with a hydraulic rotator converter according to claim 1, comprising the steps of:

removing locks associated with a hammer tool installed in a hammer housing of the hydraulic impact hammer so as to allow release of the hammer tool from the hydraulic impact hammer;

placing the hammer housing over a drill bit of the hydraulic rotator converter;

installing locks through the hammer housing so as to secure the hydraulic rotator converter to the hammer housing; and attaching a hydraulic feed line and a hydraulic return line to the hydraulic rotator converter.

15. The method of converting a hydraulic impact hammer according to claim 14, wherein the step of attaching a hydraulic feed line and a hydraulic return line to the hydraulic rotator converter further comprises respectively attaching said hydraulic feed line and hydraulic return line to a hydraulic feed line and hydraulic return line of the hydraulic impact hammer.

16. The method of converting a hydraulic impact hammer according to claim 14, further comprising placing the hammer tool in a stand upon removal of the hammer tool from the hydraulic impact hammer and placing the hydraulic rotator converter in a stand prior to installing the hydraulic rotator converter into the hammer housing.

17. A method of removing a hydraulic rotator converter according to claim 1 from a hammer housing of a hydraulic impact hammer so as to install a hammer tool in the hammer housing, comprising the steps of:

removing a hydraulic feed line and a hydraulic return line from the hydraulic rotator converter;

removing locks associated with the hydraulic rotator converter so as to release the hydraulic rotator converter from the hydraulic impact hammer;

placing the hammer housing over a hammer tool; and installing locks through the hammer housing to secure the hammer tool to the hammer housing.

* * * * *